US006048501A

United States Patent [19]

Lemaire et al.

[11] Patent Number: 6,048,501

[45] Date of Patent: Apr. 11, 2000

[54] DISPENSING DEVICE FOR DETERGENT TABLET

[75] Inventors: Liesbeth Johanna Carolina Lemaire, Roosdaal, Belgium; Rueben Earl Oder, III, Union, Ky.; Tanya Cecile Corneel Van Rompuy, Mechelen, Belgium

[73] Assignee: The Procter & Gamble Company, Cincinnati, Ohio

[21] Appl. No.: 09/051,338

[22] PCT Filed: Oct. 5, 1995

[86] PCT No.: PCT/US95/12787

§ 371 Date: Apr. 6, 1998

§ 102(e) Date: Apr. 6, 1998

[87] PCT Pub. No.: WO97/12539

PCT Pub. Date: Apr. 10, 1997

[51] Int. Cl.[7] ..... B01F 1/00

[52] U.S. Cl. ..... 422/266; 422/277; 134/93

[58] Field of Search ..... 422/266, 276, 422/277; 68/17 R; 134/93; 206/0.5; 4/227.1

[56] References Cited

U.S. PATENT DOCUMENTS 1,351,273 8/1920 Wood .

5,593,648 1/1997 Christie et al. ..... 422/266

FOREIGN PATENT DOCUMENTS 0298353 1/1989 European Pat. Off. .

2324185 11/1974 Germany .

*Primary Examiner*—Robert J. Warden, Sr.

*Assistant Examiner*—Jennifer McNeil

*Attorney, Agent, or Firm*—James C. Vago; T. David Reed

[57] ABSTRACT

A liquid permeable dispensing device adapted to retain a detergent tablet in a dish washing machine is provided. The dispensing device includes a hollow body having an opening for receiving a tablet, a base opposite the opening, and a liquid permeable side wall. A hook extends along at least a portion of the side wall for attaching the hollow body to the interior of a dish washing machine, wherein the hook has a free end disposed adjacent the base. A clip having a free end disposed adjacent to or above the free end of the hook prevents upward movement of the hollow body during use in the dish washing machine. The clip is adapted to engage a perforation of a cutlery basket in a dish washing machine while the hook is adapted to engage an exterior wall of a cutlery basket.

8 Claims, 4 Drawing Sheets

DISPENSING DEVICE FOR DETERGENT TABLET

FIELD OF THE INVENTION

The present invention relates to a dispensing device for detergent tablet for use in dish washing machines, and the like.

BACKGROUND OF THE INVENTION

Detergent compositions formed in non particulate solids such as bars or tablets or briquettes are known in the art. In the following, the term "tablet" will refer to any form of non particulate solids. The tablet provides a number of advantages to both the consumer and the manufacturer. Indeed, said tablet prevents spillage of the detergent composition. Furthermore, said tablet eliminates the need for the user to estimate the dosage of detergent composition required and ensures that the correct dosage of detergent composition per wash cycle is used by the user.

To further simplify handling and in order to maximize dissolution, thus performance of the detergent tablet, many detergent compositions manufacturers provide the consumer with dispensing devices in which to place the detergent tablet prior to being placed in the washing machine. As a result, dispensing devices in the form of baskets or cradles are often utilized for example in automatic dish washing machines to maximize the performance of the tablet.

An example of a dispensing device for tablets which may be introduced in an automatic dish washing machine is described in co-pending European Patent Application No. 95304115.9. This dispensing device may comprise a fastening means (FIG. 2, 111) which fastens said dispensing device to the interior of an automatic washing machine such that it can be released therefrom when required. In an automatic dish washing machine said dispensing device is usually attached to the exterior of the cutlery basket or the crockery basket.

We found that said dispensing device may occasionally be detached from the interior of the automatic dish washing machine during the wash cycle of this machine. This may mainly occur due to external forces acting on said dispensing device during the wash cycle. These forces may, for example, be due to the circulation of water and/or of air inside said automatic dish washing machine during the wash cycle. Also dishes and/or cutlery which inadvertently move inside said automatic dish washing machine during the wash cycle may cause the detaching of said dispensing device. Furthermore, it may then further occur that said dispensing device melts when falling on the heating elements of the automatic dish washing machine.

It is therefore an object of the present invention to provide a dispensing device for tablets of a detergent composition with an improved fastening means to avoid dropping off of said dispensing device during the wash cycle of an automatic washing machine.

SUMMARY OF THE INVENTION

The present invention provides a liquid permeable dispensing device (10) adapted to retain a detergent tablet. Said dispensing device comprises a hollow body (12) having an opening (14) to allow the introduction of said tablet into said device. Said dispensing device comprises a fastening means (20) which allows to attach said dispensing device to the interior of an automatic washing machine. Said dispensing device further comprises securing means (30) which prevents that said dispensing device is detached during the wash cycle of an automatic washing machine.

DETAILED DESCRIPTION OF THE INVENTION

In the following any form of non particulate solids such as bars or tablets or briquettes will be encompassed by the term "tablet". Said tablet is made by a detergent composition for dish or laundry washing. Said tablet may have any shape or dimension. Preferably, said solid, non particulate tablet is symmetrical to ensure the uniform dissolution of said tablet in the wash liquor.

According to the present invention the detergent tablet may comprise any ingredients known in the art. Such ingredients may include surfactants, suds suppressers, bleaches, chelants, builders, enzymes, fillers and perfumes.

According to the present invention the detergent composition of the tablet is prepared in its granular or particulate form and then formed into tablets of the desired shape and size by any one of the methods known in the art. Suitable methods include compression, extrusion and casting. The detergent composition may be homogeneously distributed throughout the tablet or may comprise distinct layers of certain detergent ingredients.

Figure 1:
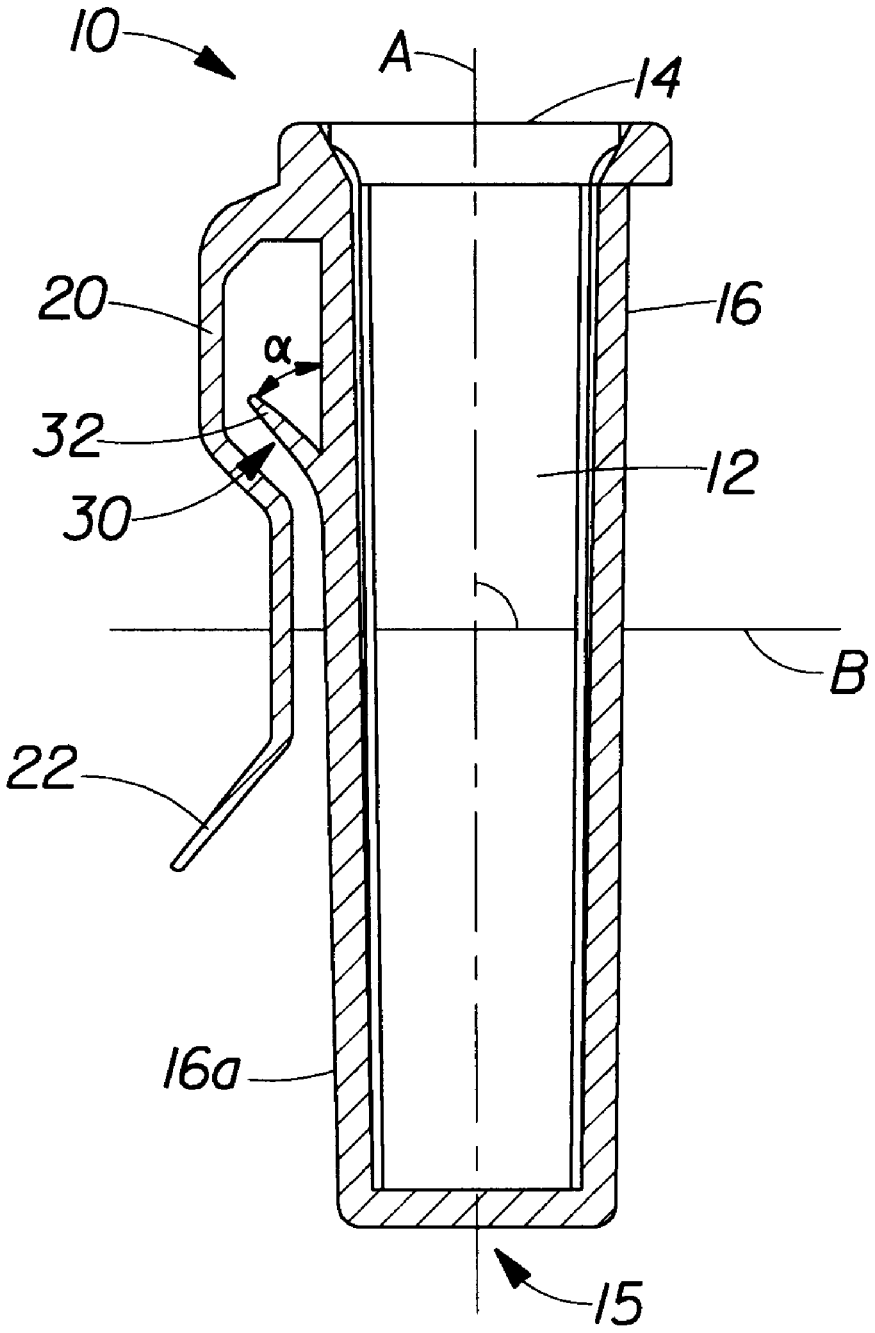
FIG. 1 is a side view of an embodiment of the dispensing device according to the present invention.

FIG. 1 shows a dispensing device (10) in a first embodiment of the present invention. Said dispensing device (10) comprises a hollow body (12). Said hollow body comprises an opening (14) and a liquid permeable side wall (16). Preferably said opening and said hollow body correspond to the configuration of the detergent tablet. This means that the shape and dimension of said opening is such that said tablet is able to be readily inserted into said device through said opening. Whereas the shape and dimension of said hollow body (12) is adapted to retain the detergent tablet.

The dispensing device (10) of the present invention is liquid permeable. This means that said device allows liquid to enter inside said device itself. Therefore a detergent tablet contained in said device can be dissolved during a wash cycle, for example, by water. The dissolved detergent tablet forms a wash liquor. This wash liquor is able then to exit the liquid permeable dispensing device to be available in the wash cycle of the washing machine. As an essential feature of the present invention said hollow body (12) is surrounded by a liquid permeable side wall (16). Said side wall is a cage or a mesh or a perforated sheet structure, so that the device has multiple orifices. Said orifices are preferably evenly distributed throughout said hollow body of said device. The orifices are such that the detergent tablet cannot be removed from said dispensing device through said orifices. Nevertheless, said orifices are such to allow water to enter said dispensing device for dissolving the detergent tablet during the wash cycle of the washing machine, making said dispensing device liquid permeable. Preferably, said hollow body of said device has a cage structure. In this case, said hollow body (12) of said dispensing device (10) comprises a rigid frame having a base (15) and a perforated side wall (16). Preferably, said side wall is substantially perpendicular to said base. Said opening (14) is preferably opposite to said base (15).

As another essential feature of the present invention, said dispensing device comprises a fastening means (20). As used herein, fastening means refers to any means which can be adapted to fasten said dispensing device to the interior of e.g. an automatic dish washing machine such that it can be released therefrom when required by the user. Said fastening means is preferably made of similar or identical material to that of said dispensing device itself. The fastening means may preferably located on said side wall (16) of said dispensing device. The fastening means preferably comprises at least a hook (22), which extends along said side wall (16). Preferably, said fastening means is adapted to be fastened on the exterior of the cutlery basket of an automatic dish washing machine.

As another essential feature of the present invention is the securing means (30). As used herein, securing means refers to any means which can be adapted to secure said dispensing device to the interior of an automatic dish or laundry washing machine such that it cannot be disengaged therefrom during the wash cycle of said automatic washing machine. Specifically, said securing means is adapted to prevent disengagement of said dispensing device due to forces occurring inside an automatic dish washing machine, as for example forces exerted by the circulation of water and/or air. Nevertheless, said securing means does not impede the release of said dispensing device from the interior of an automatic dish or laundry washing machine when required by the user. Preferably, said securing means is adapted to secure said dispensing device on the cutlery basket of an automatic dish washing machine. Said securing means is preferably made of similar or identical material as said dispensing device, but being more flexible with respect to said dispensing device itself. Other flexible material, like metals, may be also considered for the purpose of the present invention.

Figure 4A:
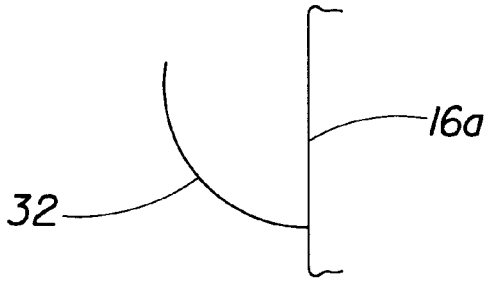
FIGS. 4*a* to 4*d* is a side view of another embodiment of the clip according to the present invention.
Figure 4B:
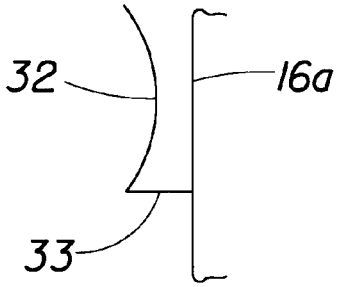
Figure 4C:
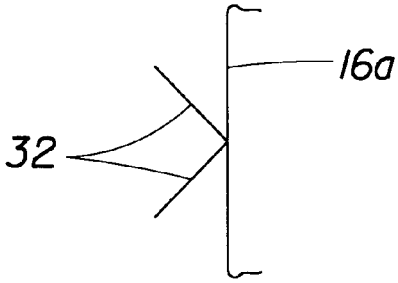
Figure 4D:
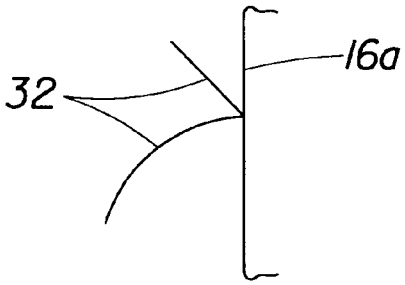

Preferably, said securing means (30) prevents said dispensing device (10) from disengaging from said cutlery basket. Preferably, said securing means prevents disengagement of said dispensing device in a direction which is opposite to the direction in which said dispensing device is fastened with said fastening means. In a preferred embodiment, said securing means (30) is an inclined arm, hereinafter referred to as "clip" (32), as illustrated in FIG. 1. Said clip may also be a curved convex or concave arm, as shown, for example, respectively in FIG. 4*a* and FIG. 4*b*. Preferably, said curved concave arm of FIG. 4*b* is connected to said side wall (16) of said dispensing device through a transition part (33). Another possible embodiment, is a clip comprising two arms, preferably pointing in opposed directions, as shown in FIG. 4*c*. FIG. 4*d* illustrates the possibility to combine inclined and curved arms. More than two arms may be also considered to form a clip according to the present invention.

Figure 2:
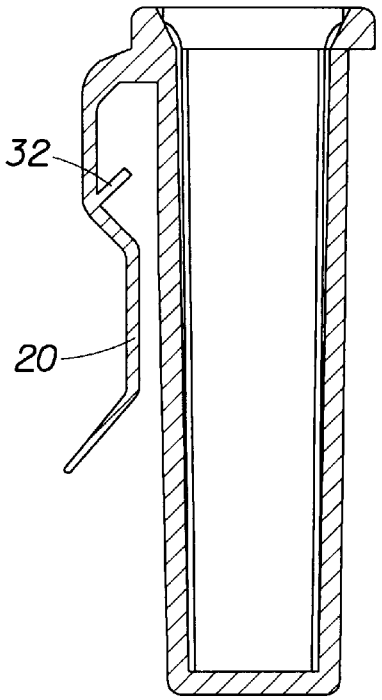
FIG. 2 is a side view of another embodiment of the dispensing device according to the present invention.

Said clip is located on the same side of said dispensing device (10) on which also said fastening means (20) is located. Specifically, said clip may be located on the part (16*a*) of said side wall (16) facing said fastening means, as illustrated for example in FIG. 1. Said clip may be also located on said fastening means, as illustrated in FIG. 2. Said clip may be attached to or integral part of said side wall (16*a*), as shown in FIG. 1. As herein defined, "upwards" is defined to be pointed towards the upper part of said dispensing device, said upper part being defined by said opening (14). On the contrary, "downwards" is in the following defined to be pointed towards the opposed direction with respect to "upwards", i.e. towards said base (15) opposing said opening. In FIG. 1 said clip points upwards, but a clip pointing downwards may also considered in an embodiment according to the present invention. Another preferred embodiment is shown in FIG. 2, where said clip is attached to or integral part of said fastening means.

Figure 3:
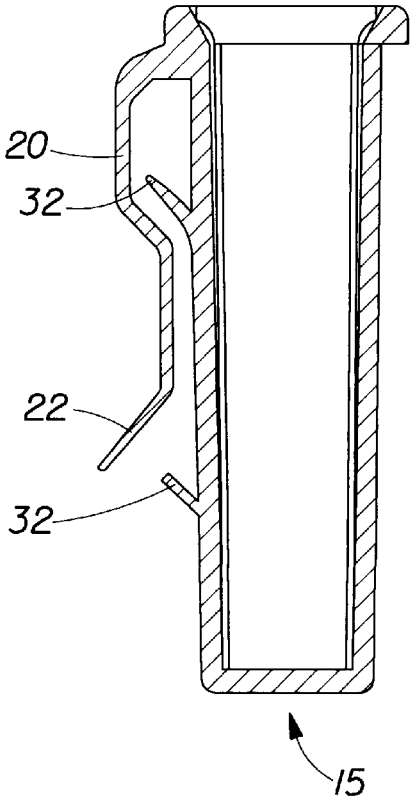
FIG. 3 is a side view of another embodiment of the dispensing device according to the present invention.

In another preferred embodiment, said securing means (30) comprises two clips (32), as illustrated in FIG. 3. Again, said clips may be located on said side wall (16*a*) or on said fastening means (20). Another possibility is to have one clip located on said fastening means, whereas the other may be located on said side wall. Both clips may point together towards the same direction, upwards or downwards, or point each one in an opposed direction. Preferably, said clips are above each other on said side wall (16*a*) along the vertical direction. The "vertical" direction is defined to be parallel to the axis (A) of said dispensing device. Said clips may be distanced also along the horizontal direction, i.e. said clips are not aligned along the same vertical line. The "horizontal" direction is the direction perpendicular to axis (A) and perpendicular to axis (B) of said dispensing device. More than two clips are also possible in an embodiment according to the present invention. In any of the above embodiments, any of said clips may also point along the horizontal direction, to the left or to the right.

Said clip (32) secures preferably said dispensing device onto the cutlery basket of an automatic dish washing machine. Said cutlery basket usually comprises perforations on its side wall. Said perforations are evenly distributed over said side wall of said cutlery basket. Consequently, there is always at least a perforation which comes into interaction with said clip when said dispensing device is fastened over said cutlery basket. Indeed, said clip fits into one of said perforations. Preferably, said dispensing device is placed on the outermost surface of said side wall of said cutlery basket whereby said hook of said fastening means plunges into the inside of said cutlery basket and said clip (32) is secured into one of said perforations from the outside to the inside of said cutlery basket.

The dimensions, i.e. length and width, of said clip are such to secure said dispensing device onto said cutlery basket. Specifically, the dimension of said inclined arm of said clip has to be small enough to fit into any of said perforations of said cutlery basket. On the contrary, said dimension has to be big enough to ensure that said clip is blocked within said perforation. Indeed, said clip should be prevented by the frame surrounding said perforation to exit said perforation. This dimensions may also depend of the specific shape of said clip, i.e. if said clip is inclined or curved and/or said clip points upwards, downwards or in the horizontal direction. Preferably, said dimensions are between about 1 mm to 10 mm of length and about 1 mm to 5 mm of width, more preferably about 5 mm of length and about 3 mm of width. The same discussion above applies for the angle $\alpha$ being the smallest angle between the inclined arm of said clip and said vertical or horizontal direction. Preferably, said angle $\alpha$ is in the range of about 0° deg to about 90° deg, preferably in the range of about 20° deg and about 70° deg, more preferably about 45° deg. In case of a clip having a curved arm, the radius of the curvature of said curved arm, is preferably between about 3 mm and about 8 mm, more preferably about 5 mm. The radius is measured from the side wall of said dispensing device.

A preferred embodiment according to the present invention, is a cradle comprising a single clip as shown in FIG. 1. The dimensions of said clip with this preferred embodiment are about 5 mm of length and 3 mm of width. This clip is located between said fastening means (20) and said side wall **(16*a*) distanced 11 mm from the opening (14)**. The angle $\alpha$ is about 45° deg.

Said clip (32) avoids great displacements of said dispensing device when said dispensing device is fastened and secured onto a cutlery basket of an automatic dish washing machine. For example, the dispensing device of FIG. 1 may be fastened and secured onto a cutlery basket and placed into an automatic dish washing machine. When upward forces act onto said dispensing device during the wash cycle of said washing machine, said dispensing device is lifted upwards until the top bar of the frame of the perforation in which said clip is positioned impedes any further displacement. Indeed, said horizontal top bar is secured in the angle a between said clip and said side wall **(16*a*)** of said dispensing device. When side forces act onto said dispensing device during the wash cycle of said washing machine, said dispensing device may move to the left or right but only within the perforation in which said clip is positioned. Indeed, said clip being inclined or curved comes in contact with the side bars of the frame surrounding said perforation.

The only way to remove said dispensing device (10) from the cutlery basket is to exert a force parallel to the axis (B) and away from said side wall of said cutlery basket. In this manner, said clip (32) is forced to exit the perforation in which said clip was secured. We found that the force necessary to unclip said dispensing device from said cutlery basket are greater than the forces exerted onto said dispensing device during the wash cycle in an automatic dish washing machine. Specifically, the circulating water and/or air in said washing machine are not strong enough to achieve a complete detachment of said dispensing device from said cutlery basket. Therefore, said dispensing device according to the present invention does not drop off from said cutlery basket during the wash cycle.

As a preferred option, said dispensing device (10) further comprises a child resistant restraining means (FIG. **5*a*, 24). Said restraining means is adapted to prevent the removal of said tablet through said opening (14)** prior to the dissolution of the tablet in the wash liquor. In particular, as used herein, the wording child resistant restraining means refers to any mechanism whereby access to the tablet, once inserted in the dispenser, is reduced so that the tablet cannot be readily removed, especially by infants and children.

Figure 5A:
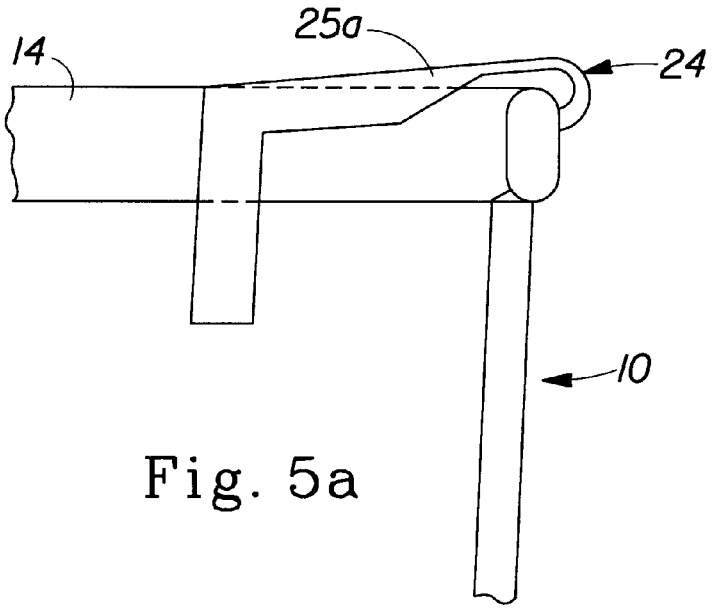
FIGS. 5*a* and 5*b* are side views of another embodiment of the dispensing device according to the present invention.
Figure 5B:
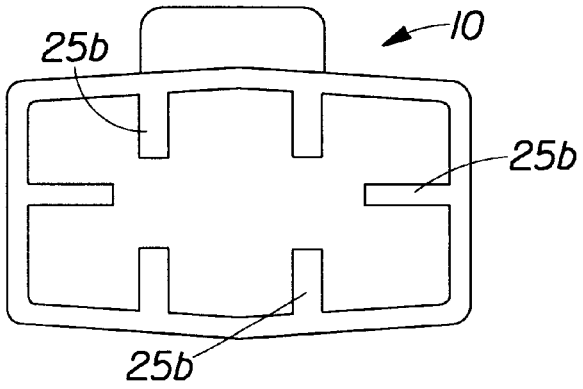

A possible child resistant restraining means (24) may be at least a resiliently hingeable **(25*a*) or deformable element (25*b*) located in the region of said opening (14) as illustrated in detail in FIGS. 5*a* and 5*b*. Said resiliently hingeable or deformable element is displaced from its rest position within said hollow body (12) of said dispensing device (10) by the insertion of the tablet. Said element has minimal, preferably no opposite hingeable motion or deformability beyond its rest position, so that the tablet cannot be removed from said hollow body once inserted therein. According to the present invention said resiliently hingeable or deformable element may entirely close or partially close said opening of said dispensing device. Any number and any positioning with any configuration of said resiliently hingeable or deformable elements around said opening (14)** may be variably chosen.

The dispensing device of the present invention may be formed from any water resistant material that can withstand moderately elevated temperatures, such as those reached in automatic washing machines, e.g. about 95° C., for a relatively long period of time (about 3 hours) and which can be formed into the desired shape. Preferably the dispensing device is made of low cost thermoplastic material such as polypropylene and formed by injection molding. The means (20) which allows to take said detergent tablet and introduce said tablet into said dispensing device without having a contact between the fingers of a user and said detergent tablet is preferably formed from the same material as the body of said dispensing device.

According to the present invention the hollow body (12) of said dispensing device (10) may be of any shape such that it can readily accommodate the detergent tablet. Preferably said dispensing device is substantially rectangular.

What is claimed is:

1. A liquid permeable dispensing device adapted to retain a detergent tablet in a dish washing machine; comprising:

a hollow body having an opening for receiving a tablet and a base opposite said opening;

a liquid permeable side wall;

a hook which extends along at least a portion of said side wall for attaching said hollow body to the interior of a dish washing machine, said hook having a free end disposed adjacent said base;

a clip having a free end disposed adjacent to or above said free end of said hook, said clip adapted to prevent upward movement of said hollow body during use in the dish washing machine; and wherein said clip is adapted to engage a perforation of a cutlery basket in a dish washing machine and said hook is adapted to engage an exterior wall of a cutlery basket.

2. The liquid permeable dispensing device of claim 1, wherein said clip is attached to said side wall.

3. The liquid permeable dispensing device of claim 1, wherein said clip is attached to said hook.

4. The liquid permeable dispensing device of claim 1, further comprising a plurality of clips.

5. The liquid permeable dispensing device of claim 1, wherein said clip is upwardly inclined.

6. The liquid permeable dispensing device of claim 1, wherein said clip is downwardly inclined.

7. The liquid permeable dispensing device of claim 1, further comprising a deformable element disposed within said hollow body, said deformable element preventing removal of the detergent tablet from said hollow body.

8. The liquid permeable dispensing device of claim 1, further comprising a resiliently hingeable element which prevents removal of the detergent tablet from said body.

* * * * *